US007731311B2

(12) United States Patent
Lam et al.

(10) Patent No.: US 7,731,311 B2
(45) Date of Patent: Jun. 8, 2010

(54) CLOSING DEVICE

(75) Inventors: Harn Lian Lam, Perak (MY); Harn Yan Lam, Perak (MY)

(73) Assignee: Harn Marketing SDN BHD, Ipoh, Perak (MY)

( * ) Notice: Subject to any disclaimer, the term of this patent is extended or adjusted under 35 U.S.C. 154(b) by 1066 days.

(21) Appl. No.: 11/429,819

(22) Filed: May 8, 2006

(65) Prior Publication Data

US 2006/0279186 A1 Dec. 14, 2006

(30) Foreign Application Priority Data

Jun. 9, 2005 (MY) ..... PI20052627

(51) Int. Cl.
*A47B 88/04* (2006.01)

(52) U.S. Cl. ..... 312/333; 312/319.1

(58) Field of Classification Search ..... 312/330.1, 312/319.1, 333, 334.1, 334.11–334.14, 334.32–334.34, 312/334.6–334.8, 334.44; 384/20, 21; 16/87.4 R, 16/87.6 R, 90, 95 R, 94 R, 78; 296/221–223
See application file for complete search history.

(56) References Cited

U.S. PATENT DOCUMENTS

| | | | | |
|---|---|---|---|---|
| 5,015,048 | A | 5/1991 | Brunnert | |
| 5,020,868 | A | 6/1991 | Brunnert | |
| 5,207,781 | A | 5/1993 | Röck | |
| 5,364,179 | A | 11/1994 | Brüstle | |
| 5,474,375 | A | 12/1995 | Hollenstein et al. | |
| 5,580,138 | A | 12/1996 | Grabher | |
| 5,907,890 | A * | 6/1999 | Redaelli | 16/96 R |
| 6,340,078 | B1 | 1/2002 | Scheible | |
| 6,736,471 | B2 * | 5/2004 | Lin | 312/333 |
| 7,249,813 | B2 * | 7/2007 | Gasser | 312/333 |
| 2002/0184733 | A1 * | 12/2002 | Lin | 16/72 |
| 2004/0000850 | A1 * | 1/2004 | Harn et al. | 312/333 |
| 2004/0104650 | A1 * | 6/2004 | Egger | 312/333 |
| 2004/0107536 | A1 * | 6/2004 | Hollenstein | 16/94 R |
| 2005/0098394 | A1 * | 5/2005 | Baldreich | 188/67 |

FOREIGN PATENT DOCUMENTS

| | | |
|---|---|---|
| AT | 398521 | 8/1991 |
| DE | 19835466 | 8/1998 |
| EP | 0 700 649 | 8/1995 |
| EP | 1 362 527 | 11/2003 |
| MY | 021 815 A | 5/2002 |

* cited by examiner

*Primary Examiner*—James O Hansen
(74) *Attorney, Agent, or Firm*—Volpe and Koenig, P.C.

(57) ABSTRACT

A closing device for a drawer comprising an elongate hollow housing which includes front and rear portions, a rotating member slidably mounted in the front portion and a resilient member mounted in the rear portion. The front portion includes first and second portions with the first portion having a rotation-preventing internal surface and the second portion having a rotation-admitting internal surface. A locking step is defined by the differing internal cross sections of the first and second portions. The rotation of the rotating member in the first portion is prevented by the internal shape of the first portion relative to the external shape of the rotating member. The rotating member has an angular slot for receiving a guiding pin which is downwardly extending from the bottom surface of a top roller guide.

16 Claims, 11 Drawing Sheets

CLOSING DEVICE

FIELD OF INVENTION

This invention relates to a closing device for use in the furniture industry, and more particularly relates to a drawer closing device.

BACKGROUND

For drawers without the closing device, the drawer that has been moved to a closed position will sometimes not be fully closed and the front panel of the drawer projects from the furniture body. As a result, it is possible for persons to bump against the front panel and injury of such persons may occur. Also, when the drawer has been pushed into the furniture body with too much energy, the drawer may again roll forward or rebound because of the excessive energy.

An existing drawer closing device has been disclosed in the Malaysian patent application no. P1 20021815. This existing closing device comprises an elongate hollow cylindrical housing having an axial slot extending from one end over at least a part of the body and a second L-shaped axial slot, a cylindrical member telescopically attached within the hollow cylindrical housing and rotatable therein with the cylindrical member having a projection extending out of the second L-shaped axial slot and a resilient member attached to the second end of the hollow housing and a rear end of the cylindrical member. The resilient member pulls the cylindrical member towards the second end of the hollow housing. The cylindrical member is disposed with an angular slot on its top surface for receiving a guiding pin of the drawer roller guide. The angled section of the second L-shaped axial slot defines a locking step for locking the axial movement of the cylindrical member.

When the drawer is opened, the guiding pin which is engaged within the angular slot pulls the cylindrical member together with the attached resilient member through the first axial slot towards the locking step. As the cylindrical member is moved axially through the first axial slot, the projection moves simultaneously within the straight section towards the angled section of the second axial slot. Upon reaching the locking step, the projection is slotted into the angled section, thereby locking the cylindrical member in position. The cylindrical member is then urged to rotate by the action of the guiding pin in the angular slot, with the guiding pin subsequently released.

With this prior closing device, the integrity of the elongate hollow housing is compromised due to the second L-shaped axial slot disposed at its side. Also, the cylindrical member is prevented and/or guided against rotational movement only by the action of the projection through the straight section of the second L-shaped axial slot. In use, this minimal guiding is not always effective at preventing initial rotational movement. Any rotational movement of the cylindrical member whilst the projection is engaged in the straight section of the second axial slot will distort the position of the guiding pin within the angular slot and cause the drawer and closing device to jam.

It has also been observed in practice, that the direct coupling of the resilient member to the cylindrical member causes friction which results in more force needing to be applied for the rotational movement of the cylindrical member. This problem together with the problems of the preceding paragraph would inevitably cause the operation of the prior closing device to be not as smooth and reliable as desired.

Additionally, the assembly of the prior closing device is also undesirably complicated due to the side projection of the cylindrical member. The cylindrical member needs to be inserted into the housing firstly, before the subsequent insertion of the side projection through the second axial slot. The second L-shaped axial slot also complicates the manufacturing of the hollow housing.

This invention thus aims to alleviate some or all of the problems of the prior art, and to provide a closing device that operates smoothly with better reliability as well as allows for ease of manufacture and assembly.

SUMMARY

In accordance with the invention, a closing device for a drawer comprises an elongate hollow housing having a front portion and a rear portion, said front portion consisting of a rotation-preventing first portion and a rotation-admitting second portion, said first and second portions of differing internal shape; a locking step defined by the differing internal shape of the first and second portions of the front portion; a rotating member slidably mounted in the front portion of the housing and a resilient member mounted in the rear portion of the housing and coupled to said rotating member. The rotating member has an angular slot to receive through an axial slot of the housing, a guiding pin of a roller guide of said drawer. In use, the rotating member is pulled axially through the front portion by said guiding pin against the action of said resilient member with rotation of the rotating member being prevented during axial movement through said first portion by the internal shape of the first portion relative to the external shape of the rotating member. Upon reaching said locking step, the rotating member is anchored thereat and is free to rotate within the second portion by the action of said guiding pin on the angular slot, to release the pin from the rotating member.

In a preferred embodiment of the invention, the internal shape of the first portion of the closing device is non-cylindrical or preferably a substantially polygonal shape or other suitable shape that will allow the rotating member to be guided therein. Most preferably, the first portion is substantially square-shaped internally. The second portion is internally cylindrical in order to allow for rotation of the rotating member, whose outer dimension is somewhat undersized relative to the cylinder diameter for this purpose. Also, the rotating member preferably has an external shape that substantially conforms to the internal shape of the first portion.

The housing of the closing device of this invention is stronger and more rigid as it does not have a side slot. Also, the entire body of the rotating member is guided in the first portion of the front portion of the housing. This addresses the problem of initial rotational movement of the rotating member within the front portion of the housing and avoids the distortion of position of the guiding pin within the angular slot. As such, these improvements provides for a closing device that operates smoothly and is more reliable.

Also, the absence of a side slot on the housing as well as a side projection on the rotating member eases the assembly and manufacture of the closing device. The absence of the projection on the rotating member as well as its external shape which relatively conforms to the internal shape of the first portion allows for the rotating member to be easily inserted by sliding through the front of the housing.

In a further embodiment, the internal shape of the first portion further comprises a groove. The rotating member further comprises a first and second lip projection with the first lip projection slidable along the axial slot and the second lip projection slidable along the groove of the first portion.

In an embodiment of the invention, the first portion is provided with a plurality of tongue projections and the rotating member is provided with a plurality of complementary internal grooves.

In another embodiment, the rotating member is provided with a plurality of tongue projections and the first portion is provided with a plurality of complementary internal grooves.

According to another embodiment of the invention, the angular slot is formed from one side edge of the rotating member and extends upwardly to the middle of the upper surface of the rotating member enabling the guiding pin to be engaged within said angular slot through the axial slot.

In a further embodiment of the invention, the rear portion of the housing is tapered towards the inner end of the front portion with a stop end formed between the rear and front portions of the housing. Also, the rear portion may be internally wider than the front portion for accommodating the resilient member.

In yet another embodiment of the invention, the rotating member is provided with a member such as a slit at the rear end for coupling with the resilient member. An adaptor is provided between the rotating member and resilient member whereby one end of the adaptor is received in the slit of the rotating member and the second end of the adaptor receives the resilient member, allowing for an indirect coupling of the resilient member with the rotating member. This indirect coupling as opposed to direct coupling between the resilient member and rotating member lessens the problem of friction and therefore, results in the use of comparatively less force for the rotational movement of the rotating member. In other words, the rotating member is at least partially decoupled from the resilient member so that rotation of the rotating member is substantially prevented from being resisted by the resilient member. This would, in turn, enhance the operation of the closing device.

Another embodiment of the invention provides that the drawer is equipped with a pull out guide system which includes a top roller guide, a bottom roller guide and an intermediate roller guide disposed therebetween. The closing device is mounted, in use, on said bottom roller guide of the pull out guide system when the guiding pin is downwardly mounted on said top roller guide. Alternatively, the closing device is mounted, in use, on said top roller guide of the pull out guide system when the guiding pin is upwardly mounted on said bottom roller guide.

In another aspect, the invention provides a closing device for a drawer comprising an elongate hollow housing including a front portion and rear portion, the housing having an axial slot over substantially the length of the front portion, and a substantial portion of the front portion is formed with guiding surface and the other portion is formed with rotatable surface and the joining portion of the two faces is formed with a locking step; a rotating member formed with guide surface which generally conforms to the guiding surface of the front portion so as to prevent rotation when the rotating member is slidably mounted therein, the rotating member having an angular slot for receiving a guiding pin mounted to a roller guide of the drawer; and a resilient member mounted at the rear portion with one end attached to the housing and the other end attached to the rotating member; wherein when the drawer is pulled out, the guiding pin pulls the rotating member through the front portion along the guiding surface and towards the rotatable surface to cause rotation of the rotating member about its center axis in the rotatable surface portion, and the consequent releasing of the guiding pin from the angular slot while the rotating member is anchored on the locking step, and when the drawer is closed, the guiding pin is inserted into the angular slot to rotate the rotating member about its center axis to a position where the conforming guide and guiding surfaces are aligned to enable the resilient member to pull the drawer to a closed position.

BRIEF DESCRIPTION OF THE DRAWINGS

The invention is illustrated, although not limited, by the following description of embodiments made with reference to the accompanying drawings in which.

DETAILED DESCRIPTION OF THE PREFERRED EMBODIMENTS

Figure 1:
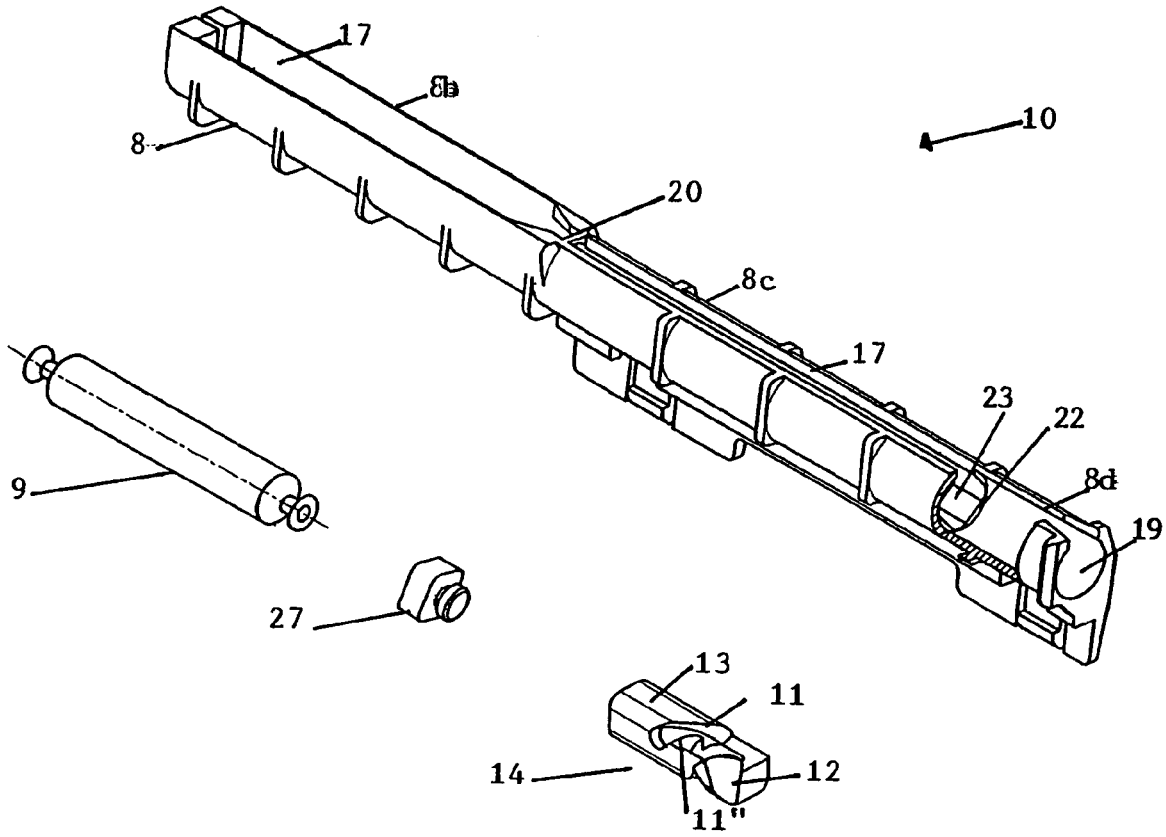
FIG. 1 illustrates an exploded view of the parts of the closing device of the preferred embodiment of the present invention.
Figure 2:
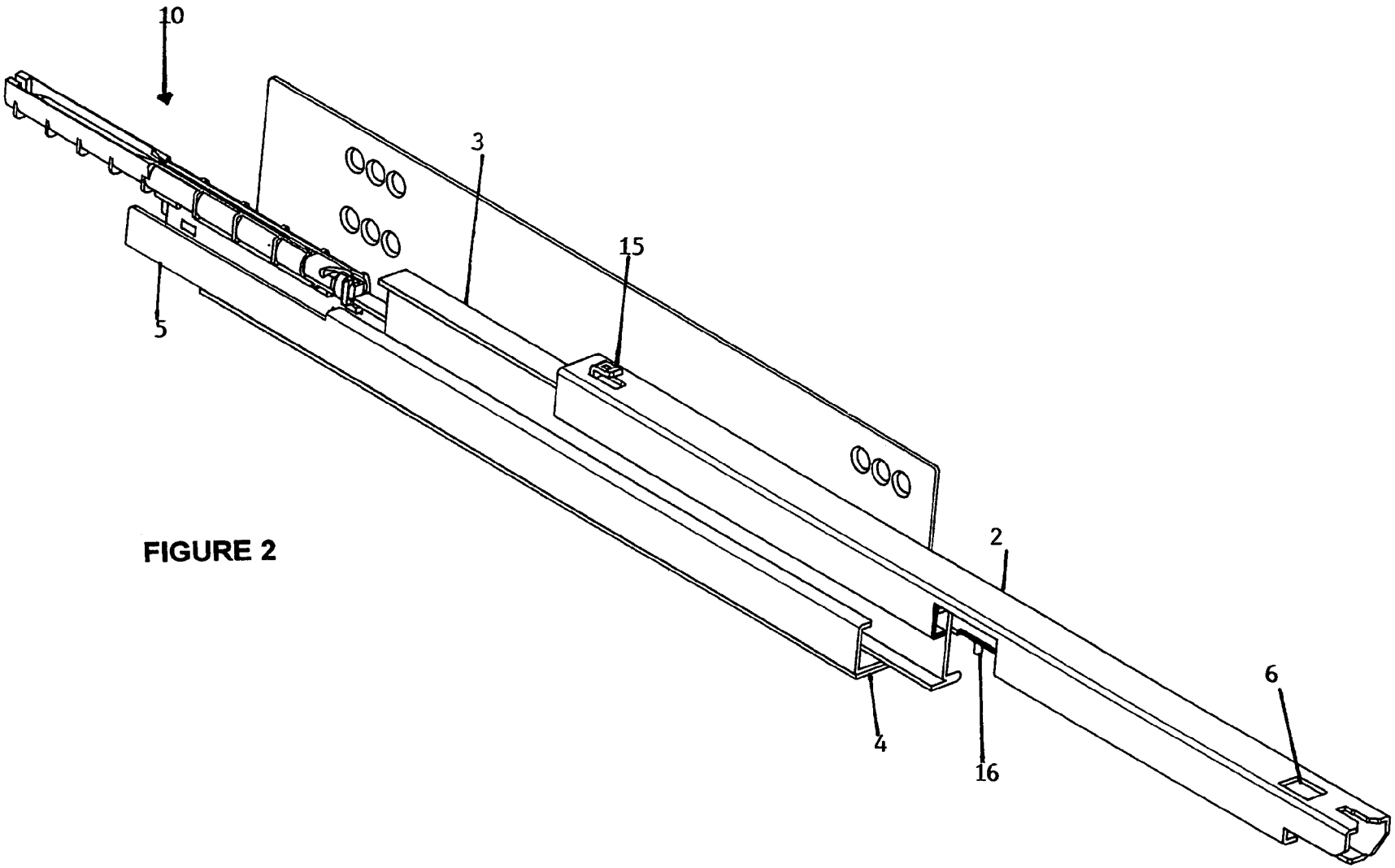
FIG. 2 shows a partial perspective view of a drawer assembly with the closing device of the preferred embodiment attached at the bottom roller guide.

A closing device 10 for a drawer of the present invention is shown in FIG. 1. The closing device 10 comprises an elongate hollow housing 8 which includes a front portion 8*a* and a rear portion 8*b*, wherein the housing has an axial slot 17 substantially along its length, a rotating member 14 slidably mounted in the front portion 8*a* of the housing and a resilient member 9 mounted in the rear portion 8*b*. The resilient member 9 attaches the rotating member 14 to the housing 8. As seen in FIG. 1, the resilient member in the form of a spring 9 is indirectly coupled to the rotating member 14 via an adaptor 27 which locks on the rotating member along with the resilient member. In a drawer assembly having a pull out guide system, the drawer is attached with a top roller guide 2 having a back stopper 15 and a front clip 6 as shown in FIG. 2. The top roller guide 2 is further equipped with a guiding pin 16 downwardly extending from the bottom surface of the top roller guide 2. The back stopper 15 is used to prevent the drawer from coming out of the top roller guide 2. The pull out guide system further comprises a bottom roller guide 5 mounted to a side wall of a chassis 1 with a bracket 4 and an intermediate roller guide 3, which travels in between the top roller guide 2 and the bottom roller guide 5. Roller housing (not shown) is placed within each roller guide and slidable along the intermediate roller guide 3. Rollers of the roller housing impart a smooth running of the drawer.

The closing device 10 is attached to the rear end of the bottom roller guide 2 as shown in FIG. 2. The rear portion 8*b* of the housing is tapered towards the inner end of the front portion 8*a* and a stop end 20 is formed between the rear portion 8*b* and the front portion 8*a* of the housing 8. The rear portion 8*b* is preferably internally wider than the front portion 8*a* of the housing for accommodating the resilient member 9. The front portion 8*a* further comprises a first portion 8*c* having a rotation preventing internal shape 23 which is non-cylindrical and a second portion 8*d* having a rotation-admitting internal shape 19 which is cylindrical. There is a locking step 22 defined by the differing internal cross section of the first 8*c* and second portions 8*d* of the front portion 8*a*.

Figure 7:
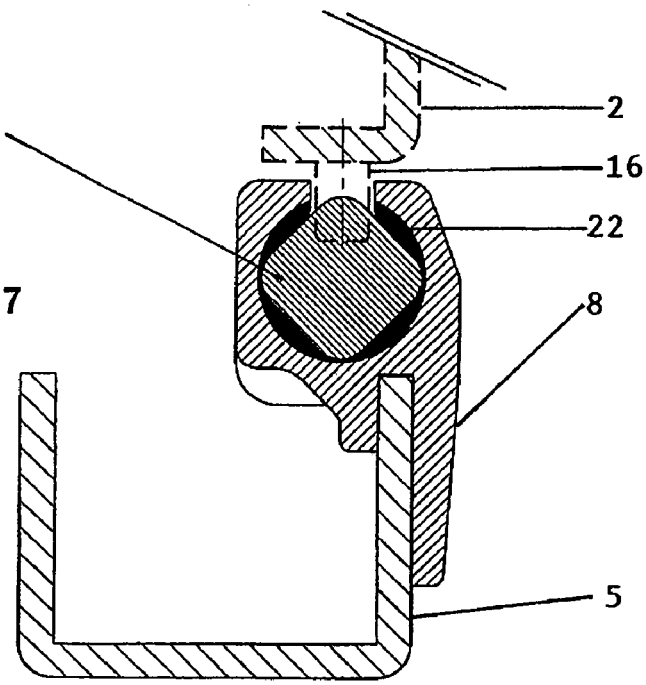
FIG. 7 shows a cross sectional view of the closing device of a preferred embodiment having a square shape for the guiding surface and the rotating member.

The rotating member 14 is slidably mounted within the front portion 8*a* of the housing 8. In this embodiment, the rotating member 14 is formed with an external shape 13 which conforms to the internal shape 23 of the first portion 8*c*. The internal shape 23 of the first portion 8*c* is non-cylindrical and preferably a polygonal shape that will allow the rotating member 14 to be guided therein, as shown in FIG. 7. The internal cross section of the first portion 8*c* is most preferably substantially square-shaped. A flap 12 is provided at the top front end of the rotating member 14. A rear slit or socket 18 provided at the bottom rear end of the rotating member 14 for receiving a boss formed on one end of the adaptor 27. The other end of the adaptor 27 is coupled to the resilient member 9. The other end of the resilient member 9 is attached to the rear end of the housing 8. The resilient member 9 is used to pull the rotating member 14 towards the stop end 20 of the front portion 8*a* of the housing 8. An angular slot 11 is formed from the one side edge of the rotating member 14 and extends upward to the middle of the upper surface of the rotating member as shown in FIG. 3.

Figure 3:
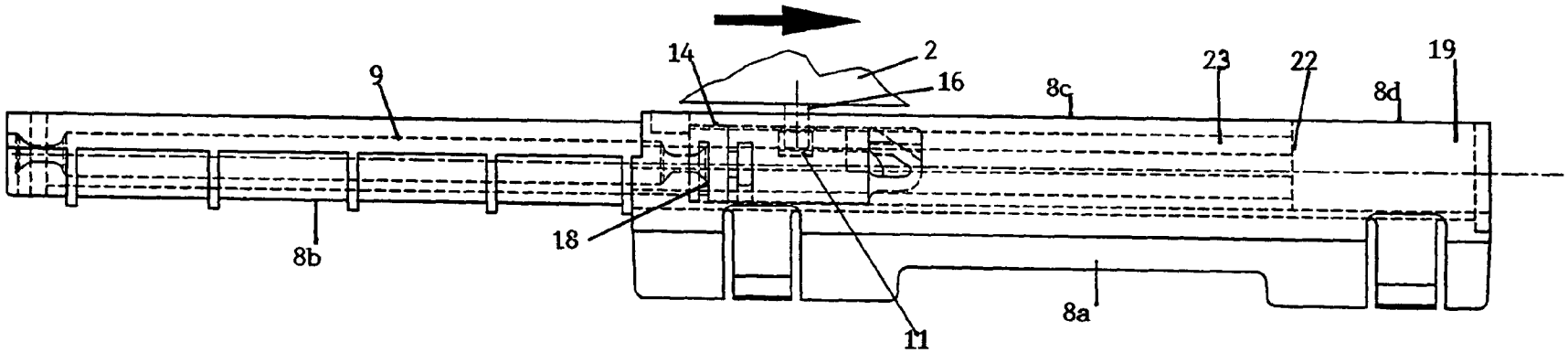
FIG. 3 shows a side view of the closing device of the preferred embodiment with the guiding pin engaged with the rotating member.
Figure 4:
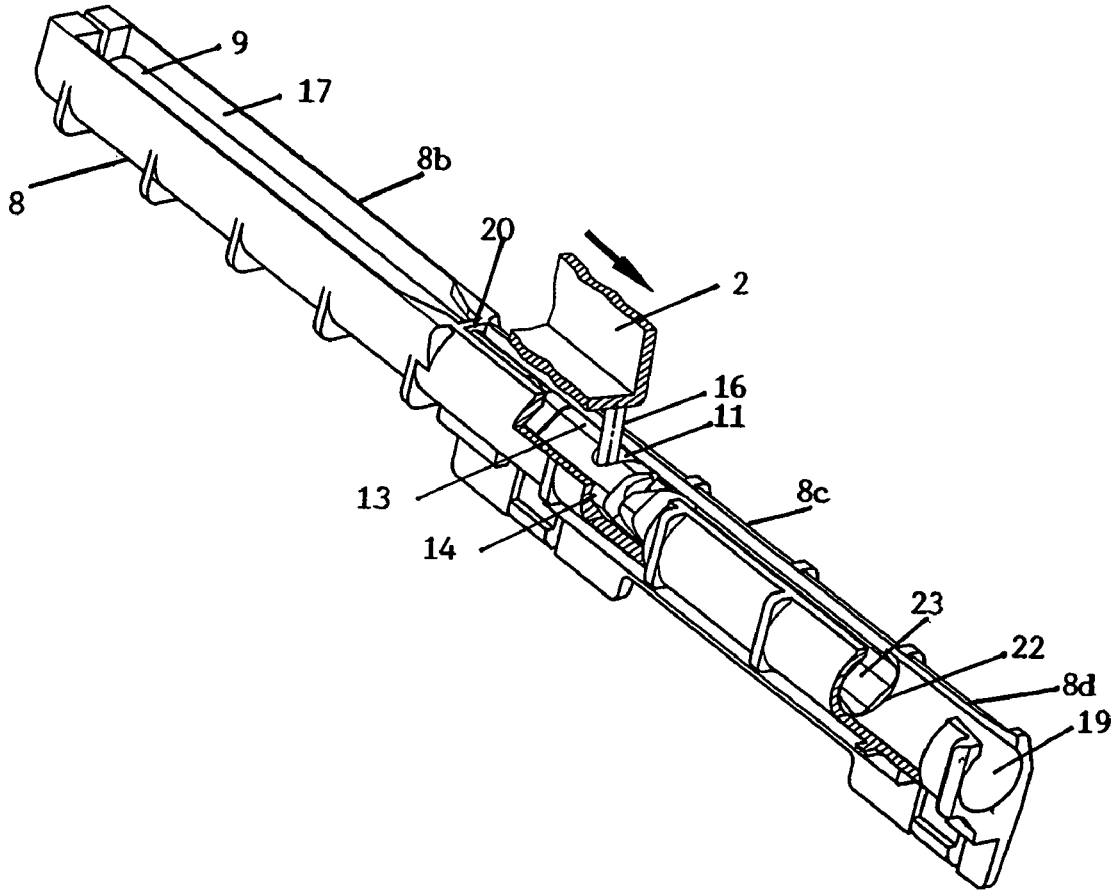
FIG. 4 depicts a perspective view of the closing device of the preferred embodiment with the rotating member at its initial position with the guiding pin engaged when the drawer is fully inserted.
Figure 5:
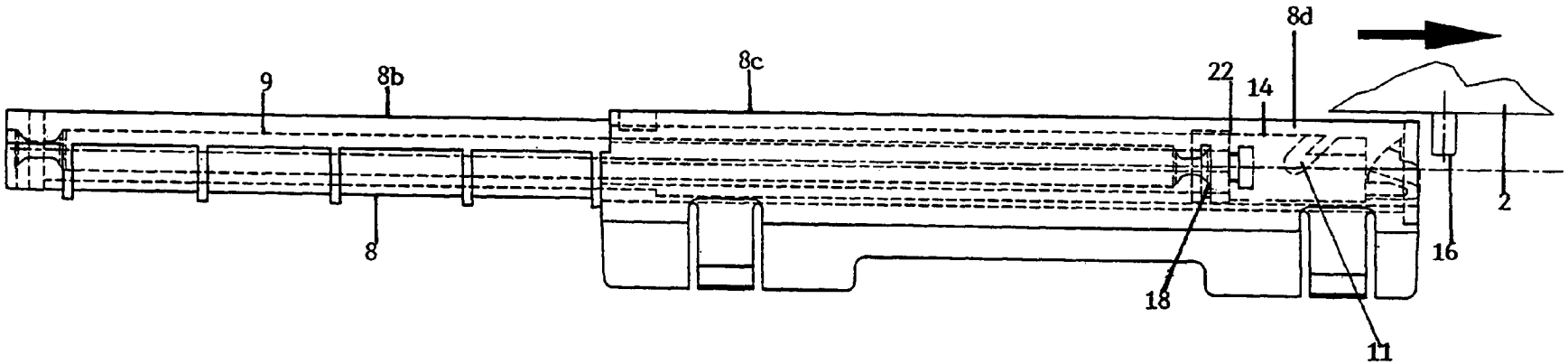
FIG. 5 is a side view of the closing device of the preferred embodiment with the rotating member rotating about its axis and the guiding pin releasing from the rotating member.
Figure 6:
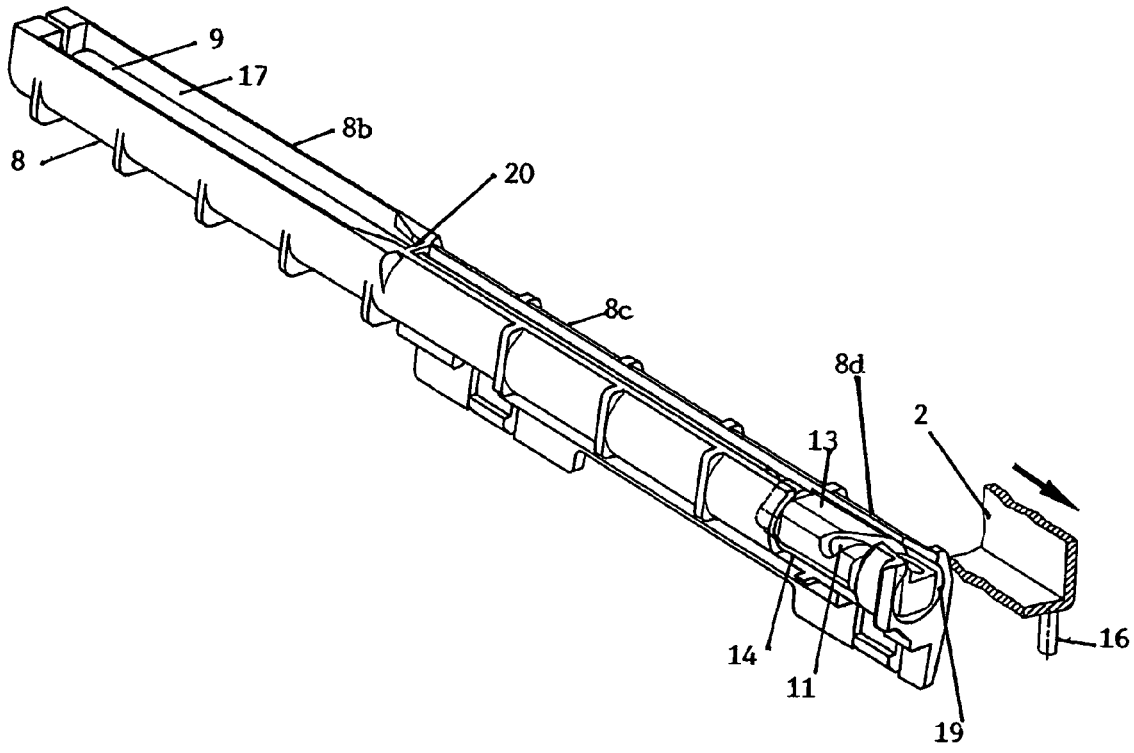
FIG. 6 is a perspective view of the closing device of the preferred embodiment with the rotating member rotating about its axis to a position to release the guiding pin.

In an assembled position, when the drawer is fully inserted, the rotating member 14 will be pulling the guiding pin 16 towards the stop end 20 of the housing 8, as shown in FIGS. 3 and 4, with the guiding pin 16 engaged with the angular slot 11 of the rotating member 14 through the axial slot 17 of the housing 8. When the drawer is pulled out of the chassis 1, the rotating member 14 is pulled axially through the first portion 8*c* of the front portion 8*a* by the guiding pin 16 against the action of said resilient member 9. The rotating member 14 is prevented from rotating during axial movement through said first portion 8*c* by the internal shape 23 of the first portion relative to the external shape 13 of the rotating member 14. When the rotating member 14 passes over the locking step 22 into the second portion 8*d* of the front portion 8*a*, the rotating member 14 is anchored thereat with the rotating member 14 having a minimum of three points of contact with the locking step 22 and is urged to rotate about its axis within the second portion 8*d* by the action of said guiding pin 16 on the second face 11" of the angular slot 11. The rotational movement of the rotating member 14 subsequently releases the guiding pin 16 from the angular slot 11 and the drawer moves freely out of the chassis 1, as shown in FIGS. 5 and 6. The angle, relative to the longitudinal axis, of the angular slot 11 determines the angle of rotation of the rotating member 14 about its axis. When the drawer is pushed in, the guiding pin 16 is engaged in the angular slot 11 from the front edge of the rotating member 14 and acts on the first face 11' of the angular slot 11. The rotating member 14 will be rotated about its axis in the second portion 8*d* as the guiding pin 16 travels further against the first face 11'. Subsequently, the rotating member 14 will be unlocked from the locking step 22. When the position of the rotating member 14 is such that the internal shape 23 of the first portion 8*c* matches that of the external surface 13 of the rotating member 14, the rotating member 14 will then be pulled axially against the stop end 20 by the resilient member 9.

Figure 8:
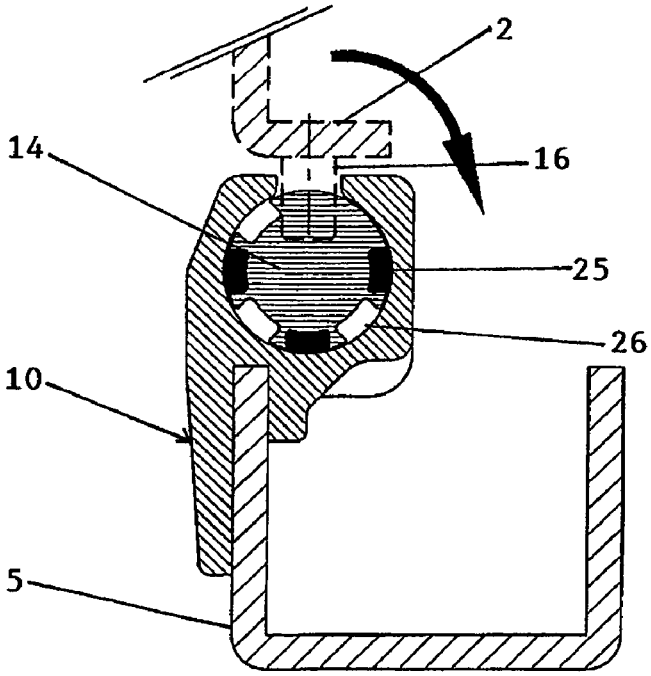
FIG. 8 depicts a cross sectional view of the rotating member of another embodiment having a circular shape with an elongate groove for receiving the elongate guide provided at the front portion of the housing.

The internal shape 23 of the first portion 8*c* of the front portion 8*a* can also have a circular internal shape having at least one tongue projection 25 for matching at least one complementary elongated groove 26 formed on the external shape 13 of the rotating member 14, as shown in FIG. 8. Alternatively, the rotating member 14 is provided with a plurality of tongue projections 25 and the first portion 8*c* is provided with a plurality of complementary internal grooves 26.

Figure 9:
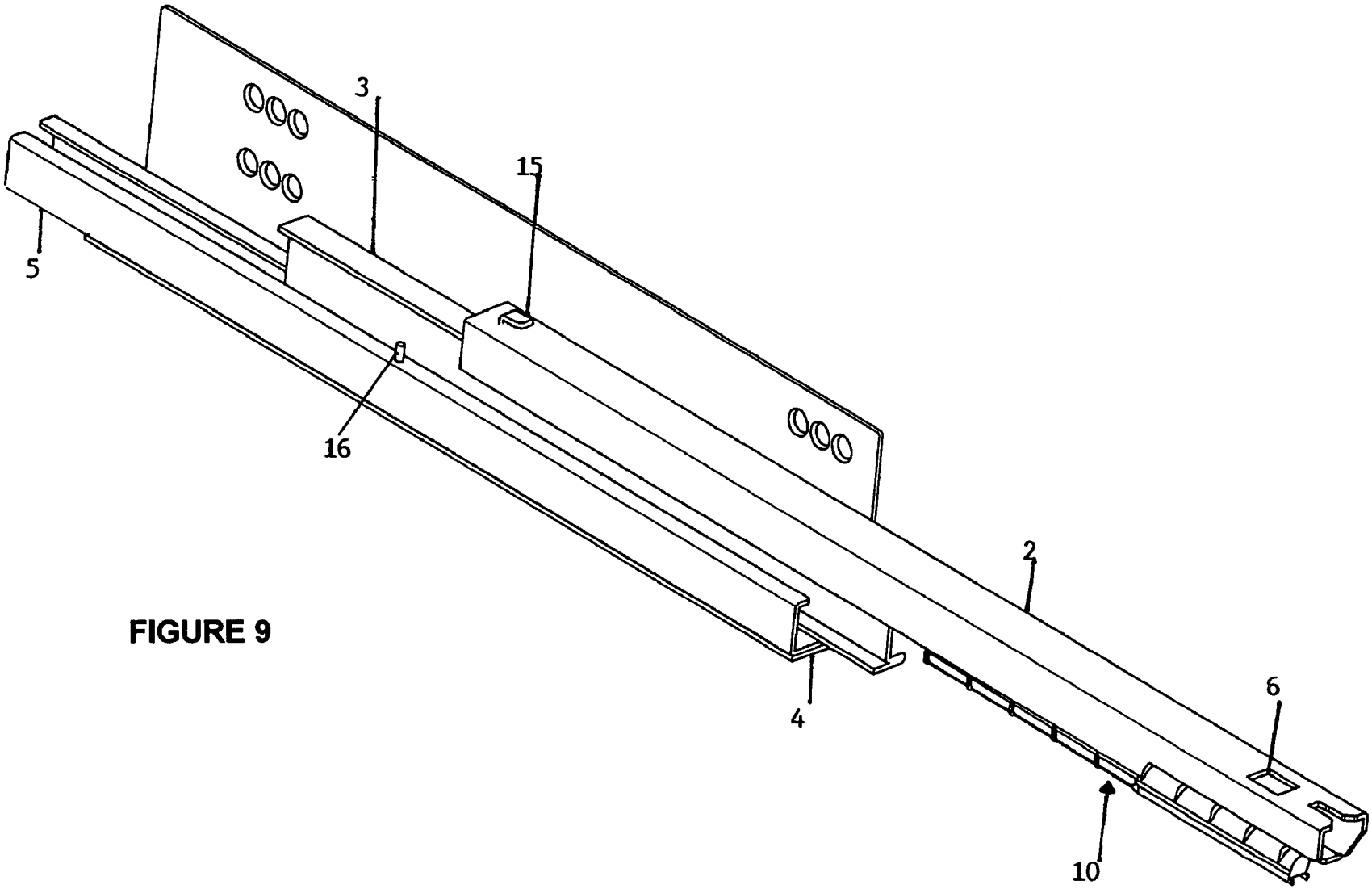
FIG. 9 is a perspective view of the closing device of a preferred embodiment mounted on the drawer side with guiding pin mounted upwards from the bottom roller guide.
Figure 10:
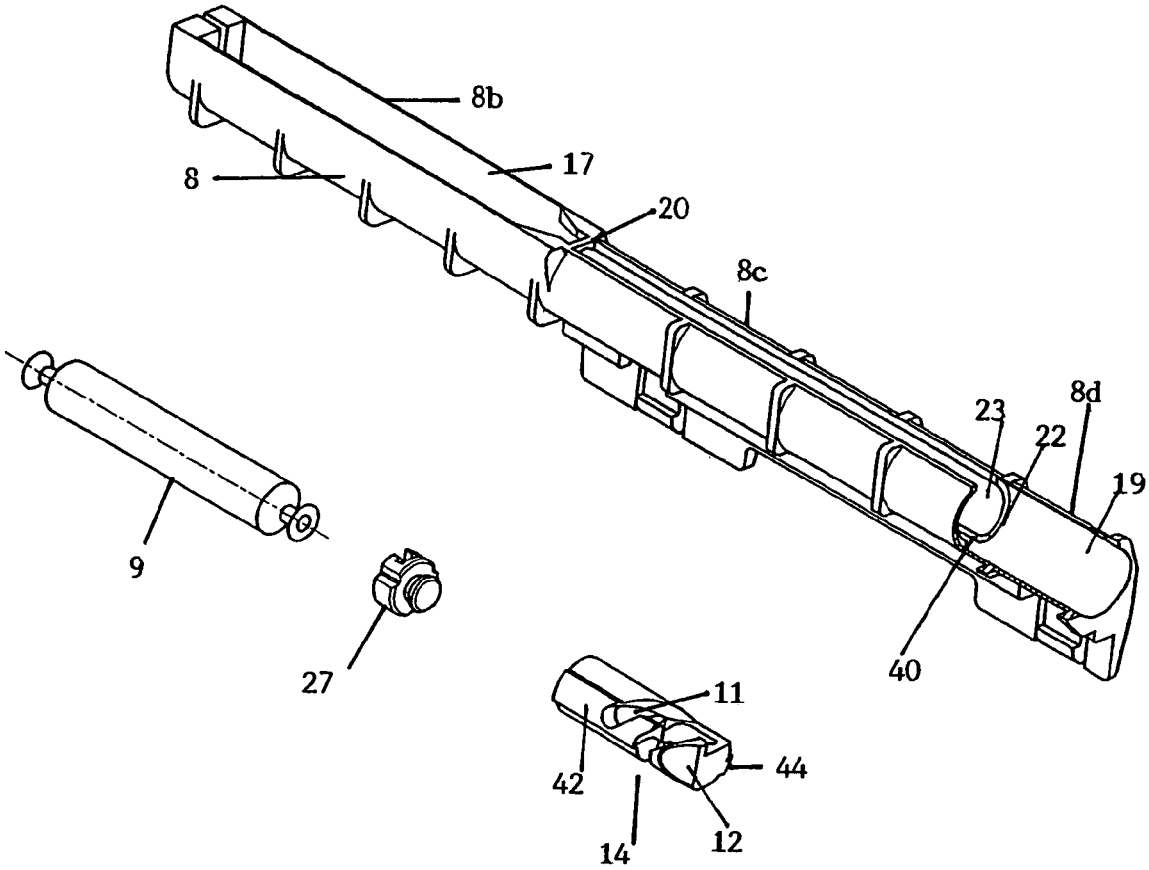
FIG. 10 depicts a perspective view of the closing device of a further embodiment with the rotating member guided by the groove and lip projection.
Figure 11:
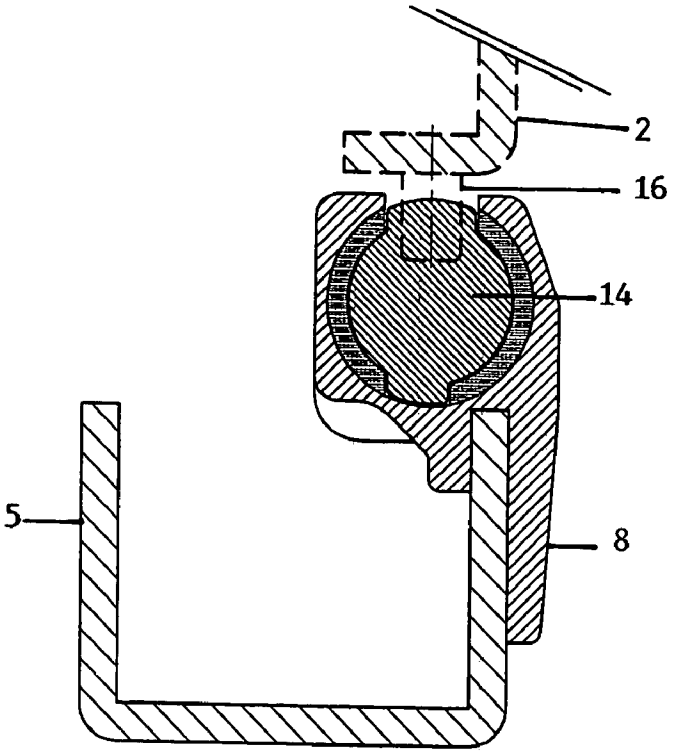
FIG. 11 shows the cross sectional view of the closing device of a further embodiment having groove on the guiding surface and the lip projections on the rotating member, before rotation.

The drawer closing device 10 can also be mounted at the front end side of the drawer or at the top roller guide 2 of the drawer having its axial slot 17 facing downward for slidably receiving a guiding pin 16 that extends upward from the bottom roller guide 5, as shown in FIG. 9. In another embodiment of the present invention, the internal shape 23 of the first portion 8*c* is further comprises a groove 40 opposed to the axial slot 17 of the front portion 8*a*, as shown in FIG. 10. The rotating member 14 of this embodiment is formed with a first lip projection 42 which is slidable along the axial slot 17 of the front portion 8*a*. A second lip projection 44 is formed on the rotating member 14 which is slidable along the groove 40 of the first portion 8*c*. The differing internal cross section of the first 8*c* and second portions 8*d* of the front portion 8*a*, defines a locking step 22 that holds the rotating member 14 in place. The angular slot 11 of the rotating member 14 of this embodiment is formed from the one side edge and extends upwardly to the upper surface at the first lip projection 42 of the rotating member 14, as shown in FIG. 11.

Figure 12:
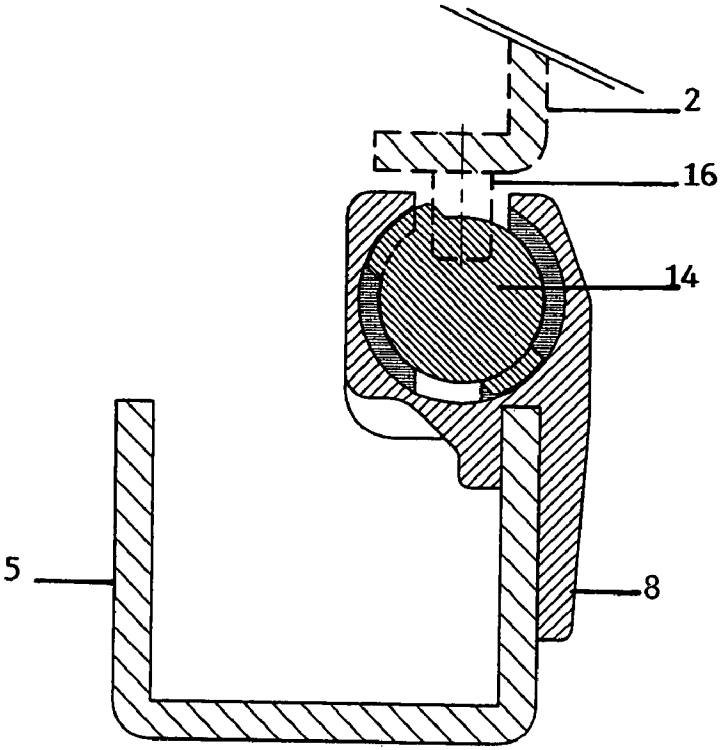
FIG. 12 shows the cross sectional view of the closing device a further embodiment when the lip projections are locked at the locking step.
Figure 14:
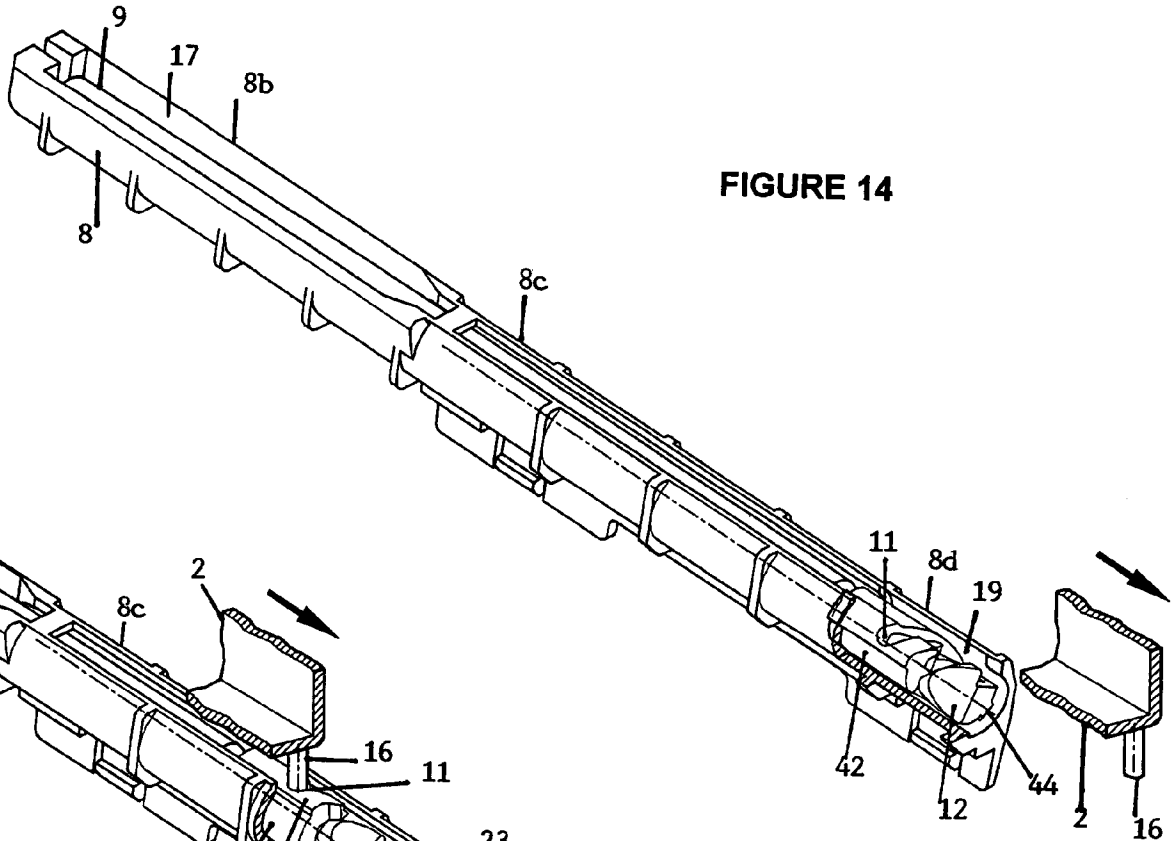
FIG. 14 is a perspective view of the closing device of a further embodiment with the rotating member having lip projections rotating about its axis to a position to release the guiding pin.
Figure 13:
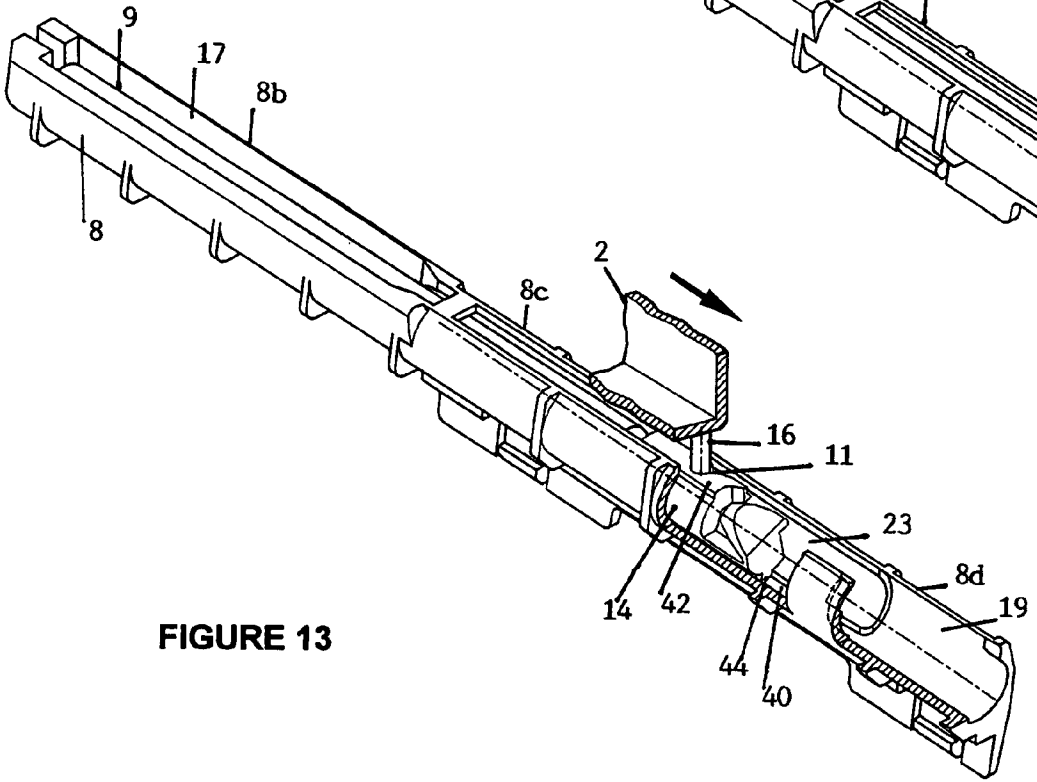
FIG. 13 depicts a perspective view of the closing device of a further embodiment with the rotating member guided by the groove and lip projections as the drawer is being pulled out.

In operation, as shown in FIG. 13, when the drawer is pulled out, the rotating member 14 is pulled axially through the first portion 8*c* of the front portion 8*a* by the guiding pin 16 against the action of said resilient member 9. The rotating member 14 is prevented from rotating during axial movement through the first portion 8*c* by the groove 40 and internal shape 23 of the first portion 8*c* relative to the external shape 13 of the rotating member 14 with the first 42 and second lip projections 44, as shown in FIG. 12. When the rotating member 14 reaches the second portion 8*d* of the front portion 8*a*, the rotating member 14 will be urged to rotate by the action of the guiding pin 16 on the second face 11" of the angular slot 11 and the end of the first 42 and second lip projections 44 will be locked on the locking step 22. The guiding pin 16 is released from the angular slot 11 due to the rotational movement and the drawer then moves freely out of the chassis 1, as seen in FIG. 14. As in the preceding embodiment, the angle of the angular slot 11 determines the angle of rotation of the rotating member 14 about its axis.

During the closing of the drawer, the guiding pin 16 is inserted into the angular slot 11 and urges the rotation of the rotating member 14. The rotational movement of the rotating member 14 releases it from the locking step 22 and aligns the second lip projection 44 with the groove 40 of the first portion 8*c*. Subsequently, the rotating member 14 is pulled axially along the groove 40 towards the stop end 20 by the resilient member 9, thereby closing the drawer.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefore intended to be embraced therein.

The invention claimed is:

1. A closing device (10) for a drawer comprising:

an elongate hollow housing (8) having a front portion (8*a*) and a rear portion (8*b*), said front portion (8*a*) consisting of a rotation-preventing first portion (8*c*) and a rotation-admitting second portion (8*d*);

said first portion (8*c*) having an internal shape that is non-cylindrical in cross-section, while said second portion (8*d*) having an internal shape of a differing cross-section;

said housing (8) having a locking step (22) defined by the differing cross-section of the internal shapes of the first and second portions;

a rotating member (14) slidably mounted in the front portion (8*a*) of the housing, said rotating member having an angular slot (11) to receive through an axial slot (17) of the housing, a guiding pin (16) of a drawer roller guide (2, 5), the rotating member (14) having an external shape that substantially conforms to the internal shape of the first portion (8*c*) such that the rotating member is prevented from rotating during axial movement through said first portion; and a resilient member (9) mounted in the rear portion of the housing and coupled to said rotating member;

whereby in use, said rotating member is pulled axially through the front portion (8*a*) by said guiding pin against the action of said resilient member with rotation of the rotating member being prevented during axial movement through said first portion (8*c*) and upon passing over said locking step into the second portion (8*d*), the rotating member is anchored thereat and is free to rotate within the second portion (8*d*) by the action of said guiding pin on the angular slot, to release the pin from the rotating member.

2. Closing device as claimed in claim 1, wherein the internal shape (23) of the first portion (8*c*) is of a substantially polygonal shape that will allow the rotating member (14) to be guided therein.

3. Closing device as claimed in claim 2, wherein the first portion (8*c*) is substantially square-shaped internally.

4. Closing device as claimed in claim 1, wherein the internal shape (19) of the second portion (8*d*) is cylindrical.

5. Closing device as claimed in claim 1, wherein the internal shape (23) of the first portion (8*c*) further comprises a groove (40).

6. Closing device as claimed in claim 5, wherein the rotating member (14) further comprises a first (42) and second lip projection (44) with the first lip projection slidable along the axial slot (17) and the second lip projection slidable along the groove (40) of the first portion (8*c*).

7. Closing device as claimed in claim 1, wherein the rotating member (14) is provided with a plurality of tongue projections (25) and the first portion is provided with a plurality of complementary internal grooves (26).

8. Closing device as claimed in claim 1, wherein the first portion (8*c*) is provided with a plurality of tongue projections (25) and the rotating member (14) is provided with a plurality of complementary internal grooves (26).

9. Closing device as claimed in claim 1, wherein the angular slot (11) is formed from one side edge of the rotating member (14) and extends upwardly to the middle of the upper surface of the rotating member enabling the guiding pin (16) to be engaged within said angular slot through the axial slot (17).

10. Closing device as claimed in claim 1 wherein the rear portion (8*b*) is tapered towards the inner end of the front portion (8*a*) with a stop end (20) formed between the rear and front portions of the housing (8).

11. Closing device as claimed in claim 1, wherein the rear portion (8*b*) is internally wider than the front portion (8*a*) for accommodating the resilient member (9).

12. Closing device as claimed in claim 1, wherein the rotating member (14) is provided with a slit (18) at the rear end for coupling with the resilient member (9).

13. Closing device as claimed in claim 12, wherein an adaptor (27) is provided between the rotating member (14) and resilient member (9) whereby one end of the adaptor is received in the slit (18) of the rotating member and the second end of the adaptor receives the resilient member, allowing for an indirect coupling of the resilient member with the rotating member.

14. A drawer comprising the closing device of claim 1, wherein said drawer is equipped with a pull out guide system which includes a top roller guide (2), a bottom roller guide (5) and an intermediate roller guide (3) disposed therebetween.

15. The drawer as claimed in claim 14, wherein the closing device is mounted, in use, on said bottom roller guide (5) of the pull out guide system when the guiding pin (16) is downwardly mounted on said top roller guide (2).

16. The drawer as claimed in claim 14, wherein the closing device is mounted, in use, on said top roller guide (2) of the pull out guide system when the guiding pin is upwardly mounted on said bottom roller guide (5).

* * * * *